US008374532B2

(12) United States Patent
Matsushita et al.

(10) Patent No.: US 8,374,532 B2
(45) Date of Patent: Feb. 12, 2013

(54) IMAGE FORMING APPARATUS

(75) Inventors: Makoto Matsushita, Osaka (JP); Akira Izutani, Takatsuki (JP)

(73) Assignee: Ricoh Company, Limited, Tokyo (JP)

( * ) Notice: Subject to any disclaimer, the term of this patent is extended or adjusted under 35 U.S.C. 154(b) by 254 days.

(21) Appl. No.: 12/830,779

(22) Filed: Jul. 6, 2010

(65) Prior Publication Data

US 2011/0008069 A1 Jan. 13, 2011

(30) Foreign Application Priority Data

Jul. 10, 2009 (JP) ..... 2009-164115

(51) Int. Cl.
*G03G 15/20* (2006.01)

(52) U.S. Cl. ..... 399/308; 399/127; 399/302

(58) Field of Classification Search ..... 399/127, 399/162, 302, 308
See application file for complete search history.

(56) References Cited

U.S. PATENT DOCUMENTS

| | | | | |
|---|---|---|---|---|
| 6,052,135 | A * | 4/2000 | Ender et al. | 347/116 |
| 6,618,565 | B2 * | 9/2003 | Sawai et al. | 399/66 |
| 6,673,499 | B2 * | 1/2004 | Lee et al. | 430/57.1 |
| 7,697,874 | B2 | 4/2010 | Izutani et al. | |
| 2003/0157420 | A1 * | 8/2003 | Bando et al. | 430/124 |
| 2008/0069599 | A1 | 3/2008 | Nakamura et al. | |
| 2008/0226997 | A1 | 9/2008 | Nakamura et al. | |
| 2008/0232849 | A1 | 9/2008 | Izutani et al. | |
| 2009/0060540 | A1 | 3/2009 | Matsushita et al. | |
| 2009/0142107 | A1 | 6/2009 | Akira et al. | |
| 2009/0180791 | A1 | 7/2009 | Matsushita et al. | |
| 2009/0186289 | A1 | 7/2009 | Nakamura et al. | |
| 2009/0190949 | A1 | 7/2009 | Hamahashi et al. | |
| 2009/0238585 | A1 | 9/2009 | Hayashi et al. | |
| 2009/0257792 | A1 | 10/2009 | Nakamura et al. | |
| 2009/0279909 | A1 | 11/2009 | Matsushita et al. | |
| 2009/0324270 | A1 | 12/2009 | Yamashita et al. | |
| 2010/0055603 | A1 | 3/2010 | Nozaki et al. | |

FOREIGN PATENT DOCUMENTS

| | | |
|---|---|---|
| JP | 8-160771 | 6/1996 |
| JP | 11-167294 | 6/1999 |
| JP | 2004-279571 | 10/2004 |
| JP | 2006-267951 | 10/2006 |
| JP | 2008-3522 | 1/2008 |
| JP | 4175714 | 8/2008 |

* cited by examiner

*Primary Examiner* — Walter L Lindsay, Jr.
*Assistant Examiner* — Roy Y Yi
(74) *Attorney, Agent, or Firm* — Oblon, Spivak, McClelland, Maier & Neustadt, L.L.P.

(57) ABSTRACT

An image forming apparatus including a latent image bearing member, a charger, an irradiator, a developing member, a transfer device, and a surface potential equalizer. The transfer device includes an intermediate transfer member comprising a high-resistivity body having a surface resistivity of $10^{13}\Omega/\square$ or more under dark conditions, a primary transfer member that transfers the toner image from the latent image bearing member onto the intermediate transfer member at a primary transfer nip, and a secondary transfer member that transfers the toner image from the intermediate transfer member onto a recording medium at a secondary transfer nip. The surface potential equalizer includes a surface potential equalizing member that equalizes a surface potential of the intermediate transfer member at a predetermined positive or negative potential. The surface potential equalizer is provided on a migration path of the intermediate transfer member from the secondary transfer nip to the primary transfer nip.

15 Claims, 7 Drawing Sheets

IMAGE FORMING APPARATUS

CROSS-REFERENCE TO RELATED APPLICATIONS

The present patent application claims priority pursuant to 35 U.S.C. §119 from Japanese Patent Application No. 2009-164115, filed on Jul. 10, 2009, which is hereby incorporated by reference herein in its entirety.

BACKGROUND

1. Field of the Invention

The present invention relates to an image forming apparatus, such as an electrophotographic copier, printer, facsimile, or multifunction apparatus combining two or more of these functions.

2. Description of the Background

Image forming apparatuses such as full-color copiers or printers that employ an intermediate transfer member are widely used. In such an image forming apparatus, multiple toner images are superimposed on one another on the intermediate transfer member in a primary transfer process, and the resulting composite toner image is then transferred onto a recording medium in a secondary transfer process.

The intermediate transfer member generally comprises a low-resistivity material, a high-resistivity material, or a combination thereof. In a case where the intermediate transfer member comprises a high-resistivity material, an electric field applied thereto can be suppressed from spreading because charges are not easily movable therein. In this case, toner particles can be normally transferred onto the intermediate transfer member without causing toner scattering or producing low granularity images. However, when such an intermediate transfer member comprising a high-resistivity material is subjected to continuous image formation, charges are likely to remain and accumulate within the intermediate transfer member, causing charge-up on the surface. Also, such an intermediate transfer member comprising a high-resistivity material generally requires a high bias voltage, which causes variation in surface potential of the intermediate transfer member among portions bearing leading and trailing edges of a recording medium, a large amount of toner particles, or a small amount of toner particles. This variation in surface potential persists through time (so-called potential history or potential memory) and produces residual images (ghosts) in the primary and secondary transfer processes.

Japanese Patent Application Publication No. (hereinafter JP-A) 2008-3522 discloses an image forming apparatus employing a transfer device which removes charges from an intermediate transfer member by contacting a conductive brush, to which a bias having the opposite polarity to the surface potential of the intermediate transfer member is applied, with the intermediate transfer member after the secondary transfer process. However, it is difficult for the conductive brush to completely remove the charges from the surface and equalize the surface potential at zero. In particular, in a case where a high transfer bias is applied for transferring a toner image onto a thick sheet of paper, the variation in surface potential cannot be completely removed.

JP-2006-267951-A and JP-H08-160771-A each disclose an image forming apparatus employing a transfer device which removes charges from an intermediate transfer member by emitting light onto the intermediate transfer member after the secondary transfer process. It is difficult to completely remove the charges from the surface by emission of light, however, and some localized charges are likely to remain on the surface of the intermediate transfer member. As a result, residual images are produced in the primary and secondary transfer processes. JP-2006-267951-A is also disadvantageous in that the plurality of intermediate transfer members employed, one for each color, makes the image forming apparatus complicated and requires a large space.

JP-H11-167294-A discloses an image forming apparatus employing a transfer device including an intermediate transfer belt having a high-resistivity layer. The high-resistivity layer controls the current value injected into the intermediate transfer member to prevent charge-up thereof. However, such a high-resistivity layer cannot completely prevent the occurrence of charge-up in the secondary transfer area, resulting in production of abnormal images.

JP-2004-279571-A discloses an image forming apparatus employing a transfer device including an intermediate transfer belt, which satisfies the inequation: |surface potential just before secondary transfer|≧|surface potential just after secondary transfer−surface potential just before secondary transfer|. Such a transfer device prevents production of residual images that results from the above-described residual surface potential history of the intermediate transfer member. However, the above inequation is satisfied only when the secondary transfer current is relatively small. Therefore, rough-surface paper, which requires a relatively large transfer current, cannot be used in the above transfer device.

Japanese Patent No. 4175714 (corresponding to JP-2000-231278-A) discloses an image forming apparatus employing a transfer device including an intermediate transfer member having a thin insulative surface layer, the thickness of which is set to 1 μm or less, to reduce residual potential. However, such a thin insulative layer has poor abrasion resistance and insulation, thereby producing abnormal images by charge leakage.

SUMMARY

Exemplary aspects of the present invention are put forward in view of the above-described circumstances, and provide a novel image forming apparatus which produces high quality images by reliably equalizing the surface potential of the intermediate transfer member.

In one exemplary embodiment, a novel image forming apparatus includes a latent image bearing member, a charger that uniformly charges a surface of the latent image bearing member, an irradiator that writes an electrostatic latent image on the charged surface of the latent image bearing member, a developing member that supplies toner particles to the electrostatic latent image to form a toner image, a transfer device, and a surface potential equalizer. The transfer device includes an intermediate transfer member comprising a high-resistivity body having a surface resistivity of $10^{13}\Omega/\square$ or more under dark conditions, a primary transfer member that transfers the toner image from the latent image bearing member onto the intermediate transfer member at a primary transfer nip, and a secondary transfer member that transfers the toner image from the intermediate transfer member onto a recording medium at a secondary transfer nip. The surface potential equalizer includes a surface potential equalizing member that equalizes a surface potential of the intermediate transfer member at a predetermined positive or negative potential. The surface potential equalizer is provided on a migration path of the intermediate transfer member from the secondary transfer nip to the primary transfer nip.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
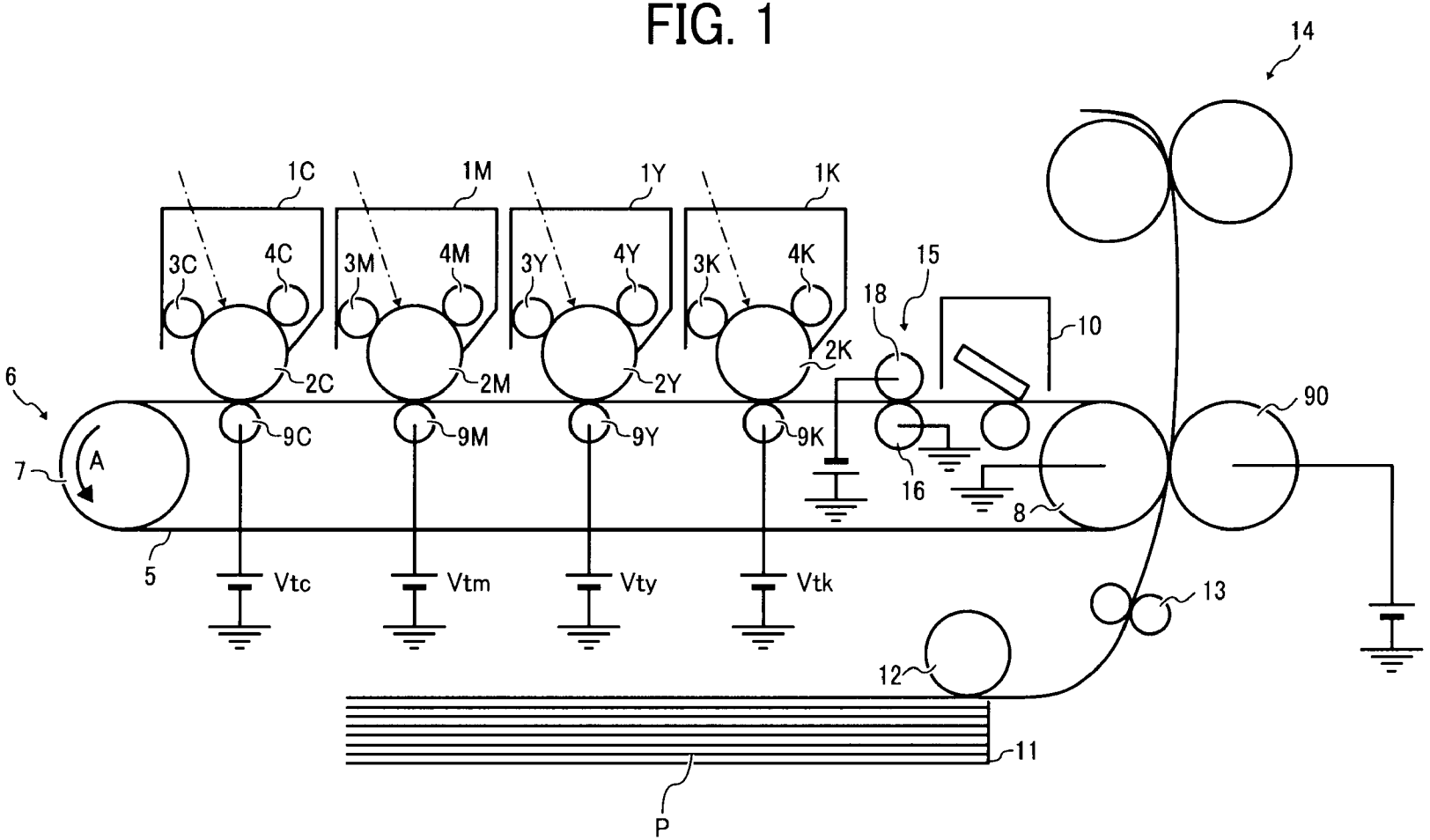
FIG. 1 is a schematic view illustrating an exemplary embodiment of the image forming apparatus according to this patent specification.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

FIG. 1 is a schematic view illustrating an exemplary embodiment of the image forming apparatus according to this patent specification. The image forming apparatus illustrated in FIG. 1 includes four process units 1K, 1Y, 1M, and 1C that form black, yellow, magenta, and cyan toner images, respectively.

The process units 1K, 1Y, 1M, and 1C have the same configuration except for containing different colors of toners, i.e., black, yellow, magenta, and cyan toners, respectively. The process unit 1K includes a drum-shaped photoreceptor 2K serving as a latent image bearing member, a charger 3K that uniformly charges a surface of the photoreceptor 2K, a developing roller 4K that develops a latent image formed on the photoreceptor 2K into a toner image, and a cleaning member, not shown, that removes residual toner particles remaining on the photoreceptor 2K. A surface of the photoreceptor 2K which has been uniformly charged by the charger 3K is exposed to a scanning laser light beam emitted from an irradiator, not shown, to form an electrostatic latent image thereon. The electrostatic latent image is developed into a black toner image in a developing area that is formed between the photoreceptor 2K and the developing roller 4K. The black toner image formed on the photoreceptor 2K is then transferred onto an intermediate transfer belt 5 by a primary transfer roller 9K. Residual toner particles remaining on the photoreceptor 2K without being transferred onto the intermediate transfer belt 5 are removed with the cleaning member. The photoreceptor 2K is neutralized and recharged by the charger 3K so as to prepare for the next image forming operation. Yellow, magenta, and cyan toner images are formed on the respective photoreceptors 2Y, 2M, and 2C in the same manner.

The intermediate transfer belt 5 is included in a transfer device 6 provided below the process units 1K, 1Y, 1M, and 1C in FIG. 1. The intermediate transfer belt 5 is stretched taut by a driving roller 7 and a support roller 8, and is driven to rotate by the driving roller 7 in a direction indicated by arrow A in FIG. 1. Within the intermediate transfer belt 5, primary transfer rollers 9K, 9Y, 9M, and 9C are provided forming respective primary transfer nips between the respective photoreceptors 2K, 2Y, 2M, and 2C, with the intermediate transfer belt 5 therebetween. Predetermined primary transfer biases Vtk, Vty, Vym, and Vtc having the opposite polarity to a toner in use are applied to the respective primary transfer rollers 9K, 9Y, 9M, and 9C from respective electric sources. The black, yellow, magenta, and cyan toner images formed on the photoreceptors 2K, 2Y, 2M, and 2C are sequentially superimposed on one another on the intermediate transfer belt 5 to form a composite toner image, due to the action of the primary transfer electric fields and the primary transfer nip pressures, while the intermediate transfer belt 5 endlessly moves along the primary transfer nips. This process may be hereinafter referred to as "primary transfer process".

Around the intermediate transfer belt 5, a secondary transfer roller 90, a cleaning device 10, and a surface potential equalizer 15, to be described in detail later, are provided. The secondary transfer roller 90 is provided so as to face the support roller 8 while contacting the outer surface of the intermediate transfer belt 5, thus forming a secondary transfer nip. A predetermined secondary transfer bias is applied to the secondary transfer roller 90 from an electric source.

A paper feed cassette 11 storing multiple sheets of a recording paper P is provided below the intermediate transfer device 6 in FIG. 1. A sheet of the recording paper P (hereinafter simply "the recording paper P") advances from the paper feed cassette 11 toward a paper feed path by rotation of the paper feed roller 12, and is sandwiched by a pair of registration rollers 13. The pair of registration rollers 13 feed the recording paper P to the secondary transfer nip in synchronization with an entry of the composite toner image formed on the intermediate transfer belt 5 into the secondary transfer nip.

In the secondary transfer nip, the composite toner image is transferred from the intermediate transfer belt 5 onto the recording paper P due to the secondary transfer electric field and the secondary transfer nip pressure. This process may be hereinafter referred to as "secondary transfer process". The composite toner image and the white color of the recording paper P combine to make a full-color image. Residual toner particles remaining on the intermediate transfer 5 after the secondary transfer process are removed by the cleaning device 10.

A fixing device 14 is provided above the secondary transfer nip in FIG. 1. The recording paper P having the composite toner image thereon separates from the intermediate transfer belt 5 and the secondary transfer roller 90, and advances toward the fixing device 14. The fixing device 14 includes a fuser roller containing a heat source and a pressure roller pressed against the fuser roller, forming a fixing nip therebetween. The recording paper P passes through the fixing nip so that the composite toner image is fixed thereon by application of heat and pressure. The resulting full-color image is discharged from the image forming apparatus.

The intermediate transfer belt 5 comprises a high-resistivity body 50 expressing a surface resistivity of $10^{13}\Omega/\square$ under dark conditions. The surface resistivity can be measured with a digital ultra-insulation/micro ammeter DSM-8104 from Hioki E.E. Corporation, for example.

Figure 2A:
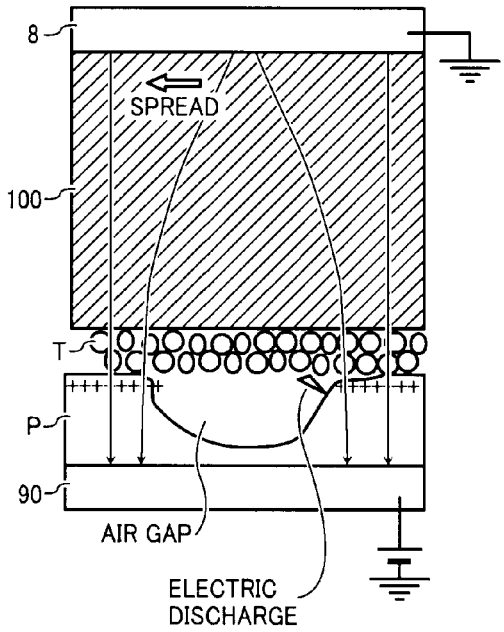
FIGS. 2A and 2B schematically illustrate cross-sectional views of the secondary transfer nip in the image forming apparatus illustrated in FIG. 1, where a comparative intermediate transfer belt and an exemplary intermediate transfer belt are in use, respectively.
Figure 2B:
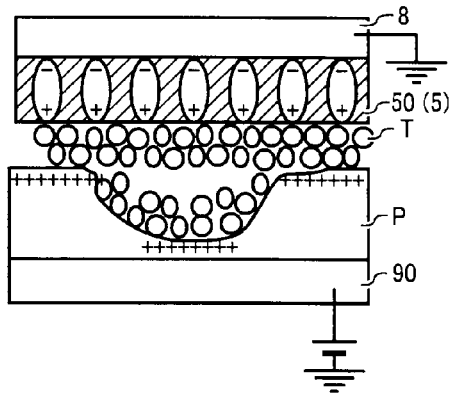

FIGS. 2A and 2B schematically illustrate cross-sectional views of the secondary transfer nip, where a comparative intermediate transfer belt 100 and the exemplary intermediate transfer belt 5 are in use, respectively.

As illustrated in FIG. 2B, in a case where the intermediate transfer belt 5 comprises the high-resistivity body 50 on its surface, advantageously, the secondary transfer electric field applied between the support roller 8 and the secondary transfer roller 90 does not spread, and the high-resistivity body 50 holds charges uniformly. In this case, toner particles T can be normally transferred from the high-resistivity body 50 onto the recording paper P even when a gap is existing therebetween.

By contrast, as illustrated in FIG. 2A, in a case where the comparative intermediate transfer belt 100 having a surface resistivity of less than $10^{13}\Omega/\square$ is in use, the secondary transfer electric field spreads along the surface direction. In this case, the toner particles T cannot be normally transferred onto the recording paper P where a gap is existing therebetween, causing scattering of the toner particles T.

An intermediate transfer belt having a surface resistivity of greater than $10^{17}\Omega/\square$ is also not preferable because it is difficult to remove a potential history even if the surface potential equalizer 15, to be described in detail later, is provided.

Figure 3:
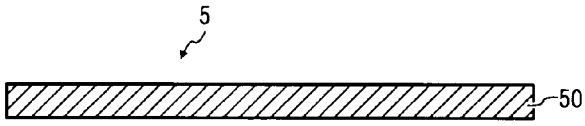
FIG. 3 schematically illustrates a cross-sectional view of one exemplary embodiment of the intermediate transfer belt according to this specification.

FIG. 3 schematically illustrates a cross-sectional view of one exemplary embodiment of the intermediate transfer belt 5. The intermediate transfer belt 5 comprises the high-resistivity body 50. The intermediate transfer belt 5 has a thickness of from 5 to 50 μm, more preferably from 10 to 30 μm. When the thickness is too small, abrasion resistance and insulation is so poor that charges may leak, resulting in production of abnormal images. When the thickness is too large, a required amount of charges cannot exist on the surface, resulting in deterioration of transfer efficiency. In a case where the intermediate transfer belt 5 is too thin, the tension in the intermediate transfer belt 5 may be reduced when mounted on the intermediate transfer device 6. Alternatively, edges of such a thin intermediate transfer belt 5 may be strengthened with a reinforcing tape comprising polyimide or PET.

Figure 4:
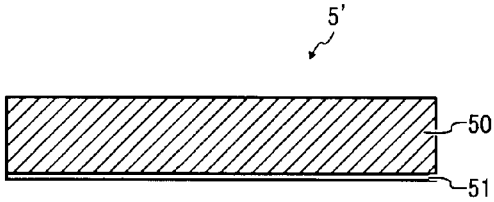
FIGS. 4 to 6 schematically illustrate cross-sectional views of other exemplary embodiments of the intermediate transfer belt according to this specification, each having a multilayer structure.
Figure 5:
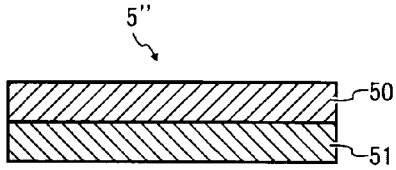
Figure 6:
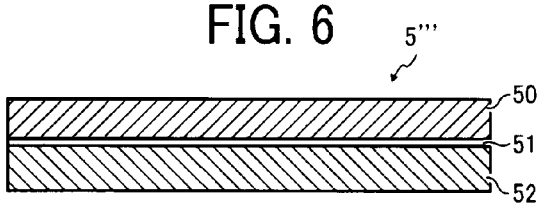

The intermediate transfer belt 5 may have either a single-layer structure, as illustrated in FIG. 3, or a multilayer structure, which is more advantageous in terms of durability. FIGS. 4 to 6 schematically illustrate cross-sectional views of other exemplary embodiments of the intermediate transfer belt according to this specification, each having a multilayer structure.

Referring to FIGS. 4 and 5, intermediate transfer belts 5' and 5" each include a conductive layer 51 comprising a conductive body, on which the high-resistivity body 50 is provided. Referring to FIG. 6, an intermediate transfer belt 5''' further includes a support 52, on which the conductive layer 51 and the high-resistivity body 50 are provided. In these embodiments, the conductive layer 51 preferably has a surface resistivity of $10^{16}\Omega/\square$ or less.

Figure 7B:
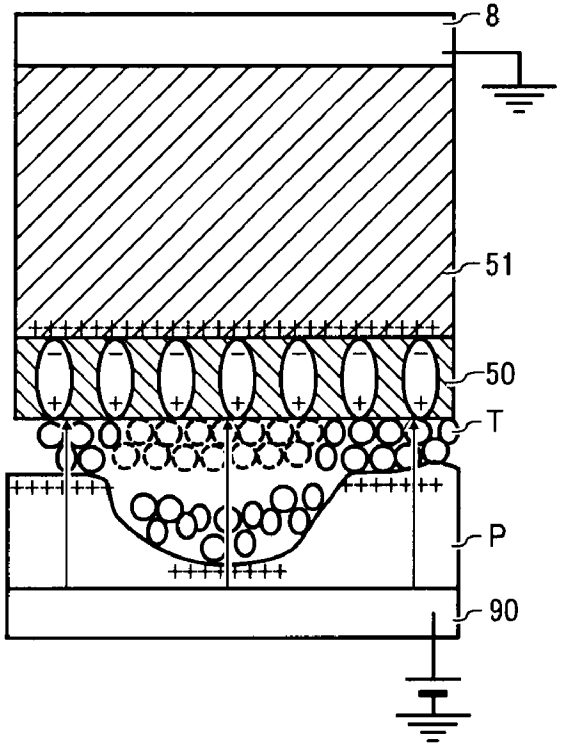
FIGS. 7A and 7B schematically illustrate cross-sectional views of the secondary transfer nip in the image forming apparatus illustrated in FIG. 1, where a comparative intermediate transfer belt including a semi-conductive layer and an exemplary intermediate transfer belt including a conductive layer are in use, respectively.
Figure 7A:
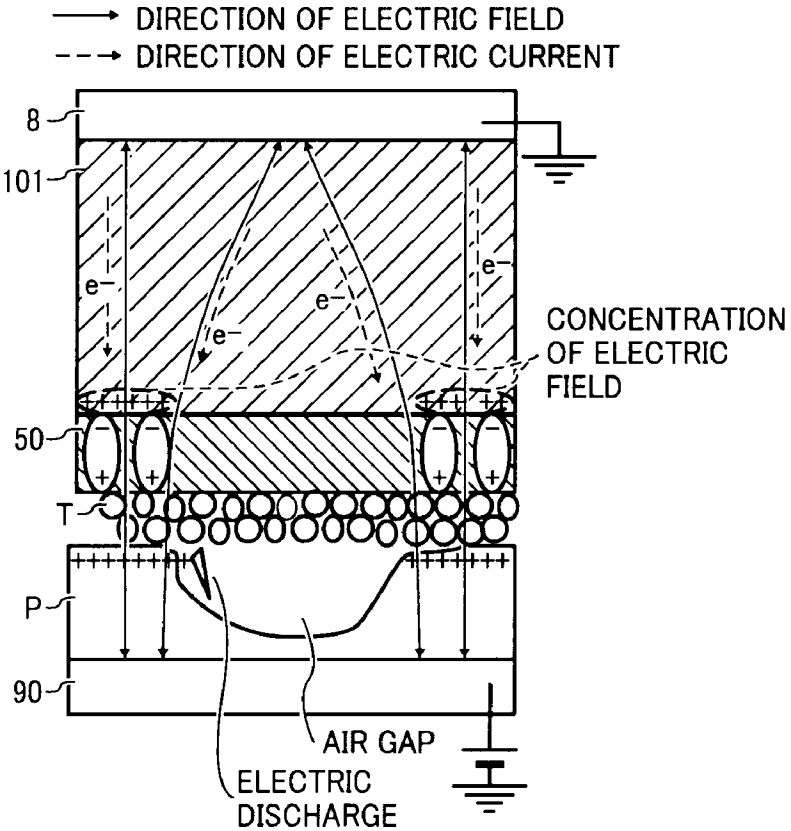

FIGS. 7A and 7B schematically illustrate cross-sectional views of the secondary transfer nip, where a comparative intermediate transfer belt including a semi-conductive layer 101 and an exemplary intermediate transfer belt including the conductive layer 51 are in use, respectively.

As illustrated in FIG. 7B, in a case where the intermediate transfer belt comprising the conductive layer 51 and the high-resistivity body 50 on its surface is in use, advantageously, the secondary transfer electric field applied between the support roller 8 and the secondary transfer roller 90 does not spread, and the high-resistivity body 50 holds charges uniformly. In this case, toner particles T can be normally transferred from the high-resistivity body 50 onto the recording paper P even when a gap is existing therebetween.

By contrast, as illustrated in FIG. 7A, in a case where the comparative intermediate transfer belt including the semi-conductive layer 101 having a surface resistivity of from $10^{7}$ to $10^{12}\Omega/\square$ is in use, charges are exchanged among the recording paper P, the toner particles T, and the high-resistivity body 50. As a consequence, the charges concentrate at an interface of a conductive portion of the semi-conductive layer 101 with the high-sensitive body 50, and the secondary transfer electric field spreads along the surface direction. In this case, the toner particles T cannot be normally transferred onto the recording paper P where a gap is existing therebetween.

Specific preferred examples of suitable materials for the high-resistivity body 50 include, but are not limited to, polyimide (PI), polyamide-imide (PAI), polyethylene terephthalate (PET), polycarbonate (PC), polybutylene terephthalate (PBT), polyvinylidene fluoride (PVDF), ethylene-tetrafluoroethylene copolymer (ETFE), urethane resins, acrylic resins, and melamine resins. Preferably, a resistivity controlling agent such as a carbon black (e.g., furnace black, acetylene black, ketjen black, acid carbon), an ionic substance, a conductive polymer, or an inorganic titanium oxide is dispersed in the above materials for adequately controlling the surface resistivity. The resistivity controlling agent may be dispersed in the above material by a kneading treatment or a dispersion treatment using a bead mill, for example. The above materials can be formed into a desired shape by extrusion molding, inflation molding, or centrifugal molding, for example.

In a case where the surface potential equalizer 15, to be described in detail later, includes a light emitting member, preferably, the high-resistivity body 50 behaves as a dielectric body having a high surface resistivity under dark conditions, while behaving as a photosensitive body under light conditions. One proposed embodiment of such a high-resistivity body 50 includes a material dispersing a charge generation material and a charge transport material in a binder agent. Another proposed embodiment of such high-resistivity body 50 includes a multilayer material including a charge generation layer and a charge transport layer. The charge generation layer and the charge transport layer respectively disperse a charge generation material and a charge transport material in a binder agent. In these embodiments, the charge generation material or layer has a function of generating charges under light conditions. On the other hand, the charge transport material or layer has a function of transporting charges by carriers (e.g., negative electrons, positive holes) under light conditions, while having a high surface resistivity under dark conditions.

Specific preferred examples of suitable materials for the charge generation material include, but are not limited to, phthalocyanine pigments, azo pigments, anthanthrone pigments, perylene pigments, perynone pigments, polycyclic quinone pigments, squarylium pigments, thiapyrylium pigments, and quinacridone pigments. These materials can be used alone or in combination. More specific examples of the azo pigments include, but are not limited to, disazo pigments and trisazo pigments. More specific examples of the perylene pigments include, but are not limited to, N,N'-bis(3,5-dimethylphenyl)-3,4,9,10-perylene-bis(carboxyimide). More specific examples of the phthalocyanine pigments include, but are not limited to, metal-free phthalocyanine (e.g., X-type, τ-type), copper phthalocyanine (e.g., ϵ-type), titanyl phthalocyanine (e.g., α-type, β-type, Y-type, amorphous type).

Specific preferred examples of suitable materials for the charge transport material include, but are not limited to, acceptor compounds such as succinic anhydride, maleic anhydride, dibromosuccinic anhydride, phthalic anhydride, 3-nitrophthalic anhydride, 4-nitro phthalic anhydride, pyromellitic anhydride, pyromellitic acid, trimellitic acid, trimellitic anhydride, phthalimide, 4-nitrophthalimide, tetracyanoethylene, tetracyanoquinodimethane, chloranil, bromanil, o-nitrobenzoic acid, malononitrile, trinitrofluorenone, trinitrothioxanthone, dinitrobenzene, dinitroanthracene, dinitroacridine, nitroanthraquinone, dinitroanthraquinone, thiopyran compounds, quinone compounds, benzoquinone compounds, diphenoquinone compounds, naphthoquinone compounds, anthraquinone compounds, stilbene quinone compounds, and azoquinone compounds. These materials can be used alone or in combination.

Specific preferred examples of suitable materials for the binder agent in the high-resistivity body 50 include, but are not limited to, a polycarbonate resin alone, and a combination of a polycarbonate resin with another resin such as a polyester resin, a polyvinyl acetal resin, a polyvinyl butyral resin, a polyvinyl alcohol resin, a vinyl chloride resin, a vinyl acetate resin, a polyethylene, a polypropylene, a polystyrene, an acrylic resin, a polyurethane resin, an epoxy resin, a melamine resin, a silicone resin, a polyamide resin, a polystyrene resin, a polyacetal resin, a polyarylate resin, a polysulfone resin, or a homopolymer or copolymer of methacrylates. Also, a mixture of the same type of resins having different molecular weights is also usable.

For the purpose of improving resistance to environmental conditions and harmful light rays, the high-resistivity body 50 may include a deterioration preventer such as an antioxidant and/or a light stabilizer. Specific examples of usable materials for the deterioration preventer include, but are not limited to, chromanol derivatives (e.g., tocopherol), esterified compounds, polyarylalkane compounds, hydroquinone derivatives, etherified compounds, dietherified compounds, benzophenone derivatives, benzotriazole derivatives, thioether compounds, phenylenediamine derivatives, phosphonate esters, phosphite esters, phenol compounds, hindered phenol compounds, straight-chain amine compounds, cyclic amine compounds, and hindered amine compounds. Additionally, for the purpose of improving lubricity, the high-resistivity body 50 may also include a leveling agent, such as a silicone oil or a fluorine-containing oil. Further, for the purposes of reducing the friction coefficient and improving lubricity, the high-resistivity body 50 may also include fine particles of a metal oxide (e.g., silicone oxide (silica), titanium oxide, zinc oxide, calcium oxide, aluminum oxide (alumina), zirconium oxide), a metal sulfate (e.g., barium sulfate, calcium sulfate), a metal nitride (e.g., silicon nitride, aluminum nitride), or a fluorocarbon resin (e.g., a tetrafluoroethylene resin, a fluorine-containing comb-like graft polymer).

Next, the surface potential equalizer 15 is described in detail below. As described above, the intermediate transfer belt 5 comprising the high-resistivity body 50 requires a relatively high transfer bias. When transferring a toner image from the intermediate transfer belt 5 onto the recording medium P, a relatively high transfer bias having a voltage of 1 to 2 kV may be applied to the intermediate transfer belt 5 in some cases, depending on the condition of the recording paper P. Such a high bias voltage causes variation in surface potential of the high-resistivity body 50 among portions bearing leading and trailing edges of a recording medium, a large amount of toner particles, or a small amount of toner particles. The variation in surface potential disadvantageously produces residual images in the primary and secondary transfer processes. The surface potential equalizer 15 evens out the surface potential variation, so that the intermediate transfer belt 5 has a uniform predetermined positive or negative surface potential. The surface potential equalizer 15 is provided on the migration path of the intermediate transfer belt 5 from the secondary transfer nip to the primary transfer nip, so as not to be influenced by the secondary transfer bias. More preferably, the surface potential equalizer 15 is provided downstream from the cleaning device 10.

The surface potential equalizer 15 comprises a surface potential equalizing member and a metallic roller 16. The metallic roller 16 faces the surface potential equalizing member with the intermediate transfer belt 5 therebetween, and is grounded. The surface potential equalizing member may be in a form of a brush, a roller, a combination of a brush and a roller, or a film, for example. The surface potential equalizing member applies a bias to the intermediate transfer belt 5.

Figure 8:
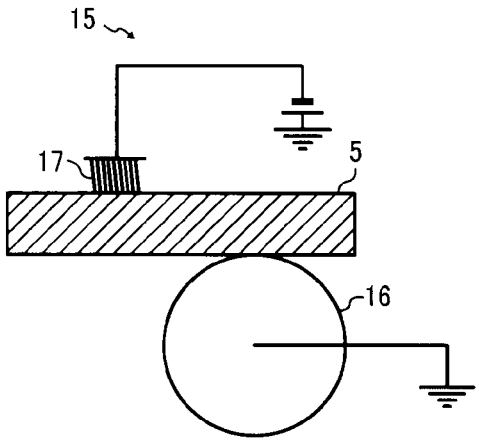
FIG. 8 schematically illustrates one embodiment of the surface potential equalizer including a brush-shaped surface potential equalizing member.

FIG. 8 schematically illustrates one embodiment of the surface potential equalizer 15 including a brush-shaped surface potential equalizing member 17. The brush-shaped surface potential equalizing member 17 may be comprised of, for example, a 6-nylon having a fineness of 220T/96F, a density of 240 kf/inch$^2$, an original yarn resistance of 5 Log Ω, and a pile length of 5 mm, or a 6-nylon having a fineness of 330T/48F, a density of 80 kf/inch$^2$, an original yarn resistance of 5.5 Log Ω, and a pile length of 5 mm. As illustrated in FIG. 8, the brush-shaped surface potential equalizing member 17 is fixedly provided. Alternatively, the brush-shaped surface potential equalizing member 17 may be in a form of a roller which can rotate in either direction, or can be driven to rotate by the intermediate transfer belt 5.

Figure 9:
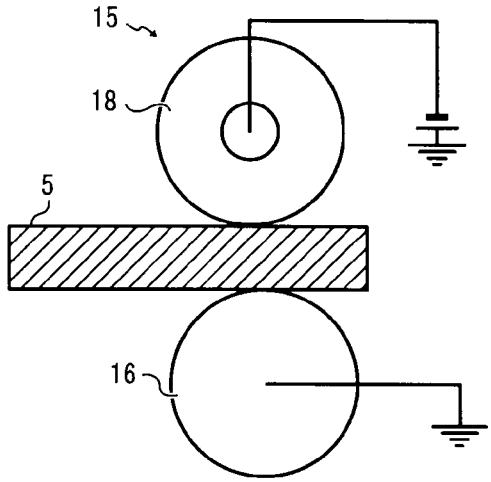
FIG. 9 schematically illustrates another embodiment of the surface potential equalizer including a roller-shaped surface potential equalizing member.

FIG. 9 schematically illustrates another embodiment of the surface potential equalizer 15 including a roller-shaped surface potential equalizing member 18. The roller-shaped surface potential equalizing member 18 comprises a base material in which a resistivity controlling agent is added. Specific examples of the resistivity controlling agent include, but are not limited to, carbon blacks (e.g., furnace black, channel black, acetylene black), ion transfer agents, and inorganic oxides. Such resistivity controlling agents may be dispersed in the base material by applying mechanical shearing force with a single-axis extruder, a double-axis extruder, a planetary-axis extruder, a conical-axis extruder, a sealed mixer, a Z-type kneader, or a bead mill. Alternatively, the roller-shaped surface potential equalizing member 18 may have a multilayer structure including a rubber base layer and a surface layer. The surface layer may be a medium-resistivity layer or a release layer comprising a silicone resin, etc. The roller-shaped surface potential equalizing member 18 may be capable of rotating in either direction, or being driven to rotate by the intermediate transfer belt 5.

In the above embodiments, the surface potential equalizing member 17 or 18 applies a surface potential equalizing bias to the intermediate transfer belt 5, so that the intermediate transfer belt 5 has a uniform predetermined positive or negative surface potential after the secondary transfer process. It is much easier to equalize the surface potential of the intermediate transfer belt 5 at a predetermined positive or negative surface potential than at zero. Additionally, the surface potential equalizer 15 also prevents the occurrence of charge-up of the high-resistivity body 50.

The surface potential equalizer 15 applies a bias to the intermediate transfer belt 5 by application of DC voltage, charge injection, or superposition of DC and AC voltages, for example.

Figure 10:
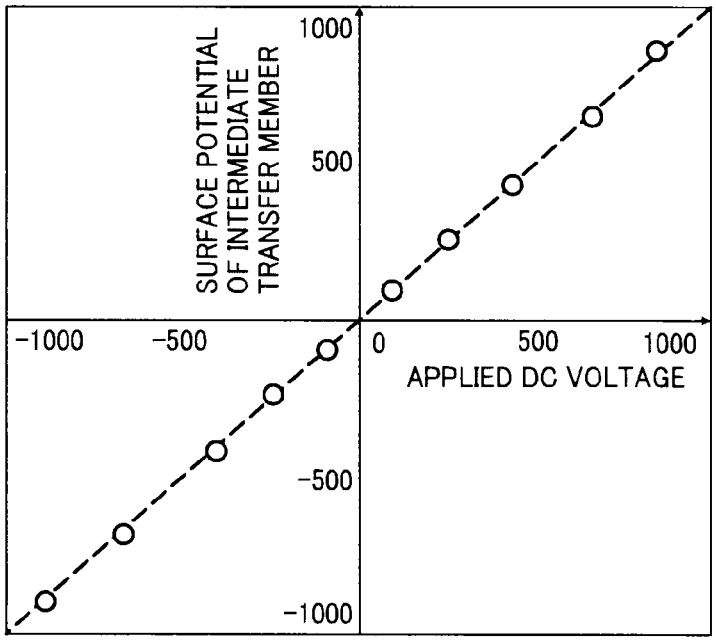
FIG. 10 shows a relation between the applied DC bias and the surface potential of the intermediate transfer belt according to this specification, in a case where the bias is applied by charge injection.

FIG. 10 shows a relation between the applied DC bias and the surface potential of the intermediate transfer belt 5, in a case where the bias is applied by charge injection. In such a case, the surface potential can be arbitrarily controlled, even when the bias is a relatively low voltage of about ±10 to ±300 V. No threshold value is observed when controlling the surface potential by charge injection.

By contrast, in a case where the surface has a potential difference history of 100 V and the surface potential is equalized by electric discharge, the potential difference history is likely to remain when the applied bias voltage is relatively low. Even when electric discharge is caused above the threshold value, the potential difference history is more likely to remain compared to the case where the surface potential is equalized by charge injection.

Figure 11:
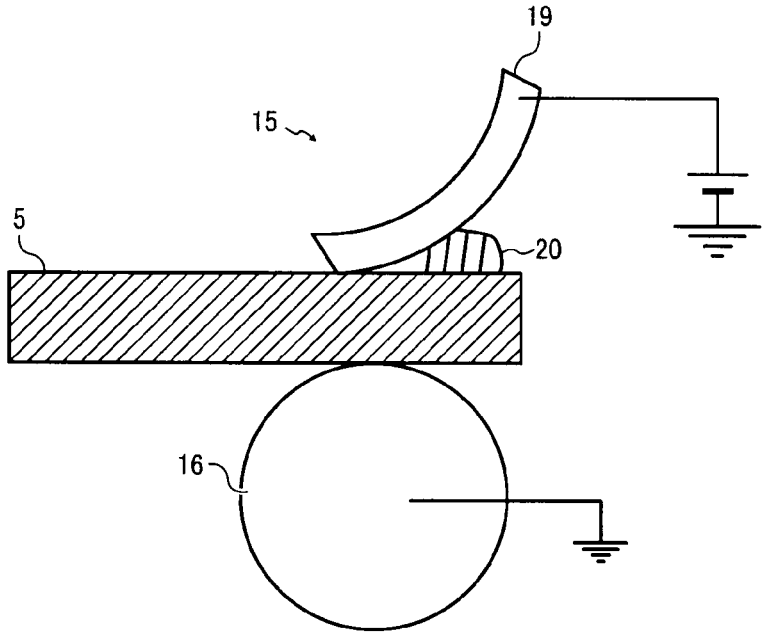
FIG. 11 schematically illustrates one embodiment of the charge-injection type surface potential equalizer including a blade-shaped surface potential equalizing member.

FIG. 11 schematically illustrates one embodiment of the charge-injection type surface potential equalizer 15 including a blade-shaped surface potential equalizing member 19. In this embodiment, water 20 mediates between the blade-shaped surface potential equalizing member 19 and the intermediate transfer belt 5, for injecting charges into the intermediate transfer belt 5. The surface potential of the intermediate transfer belt 5 is equalized at a predetermined positive or negative potential by the charge injection. The blade-shaped surface potential equalizing member 19 may be a metallic blade, a rubber blade, or a resin blade, for example.

Figure 12:
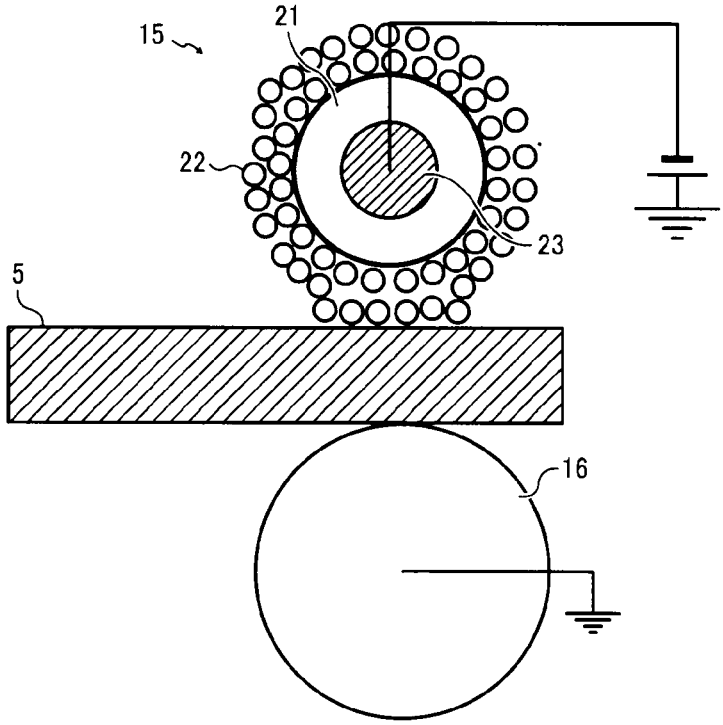
FIG. 12 schematically illustrates another embodiment of the charge-injection type surface potential equalizer including a sleeve electrode serving as the surface potential equalizing member.

FIG. 12 schematically illustrates another embodiment of the charge-injection type surface potential equalizer 15 including a sleeve electrode 21 serving as the surface potential equalizing member. In this embodiment, the sleeve electrode 21 bears carrier particles 22 on its surface. A magnet 23 contained within the sleeve electrode 21 and the carrier particles 22 form magnetic brushes that injecting charges into the intermediate transfer belt 5. Each of the carrier particles 22 comprises a core material, a coating material, and a resistivity controlling agent. Specific preferred materials for the core material include, but are not limited to, iron, ferrite, and magnetite. Specific preferred materials for the coating material include, but are not limited to, silicone resins, acrylic resins, polyester resins, polyethylene resins, fluorine-containing resins, and nitrogen-containing resins. Specific preferred materials for the resistivity controlling agent include, but are not limited to, carbon blacks (e.g., acetylene black, furnace black, ketjen black), inorganic oxides (e.g., titanium oxide, tin oxide, zinc oxide), and conductive fine particles.

Figure 13:
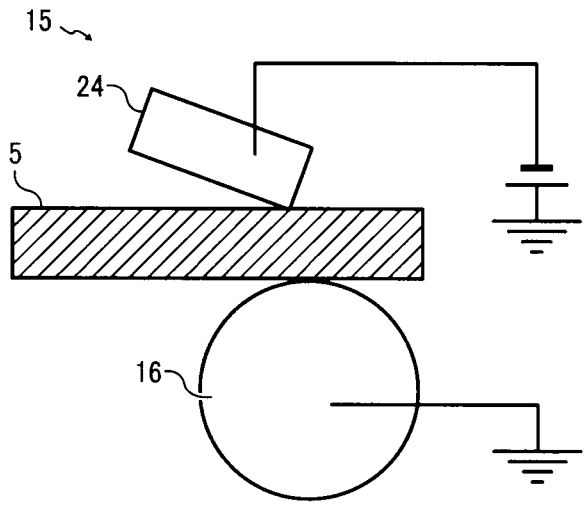
FIG. 13 schematically illustrates one embodiment of the surface potential equalizer including a blade-shaped surface potential equalizing member that also serves as a cleaning member.

The surface potential equalizer 15 may also serve as a cleaning member in terms of space and cost reduction. FIG. 13 schematically illustrates one embodiment of the surface potential equalizer 15 including a blade-shaped surface potential equalizing member 24 that also serves as a cleaning member. In this embodiment, the blade-shaped surface potential equalizing member 24 removes residual toner particles remaining on the intermediate transfer belt 5 upon application of a cleaning bias, while charging the surface of the intermediate transfer belt 5 to a predetermined positive or negative potential upon application of a surface potential equalizing bias.

Figure 14:
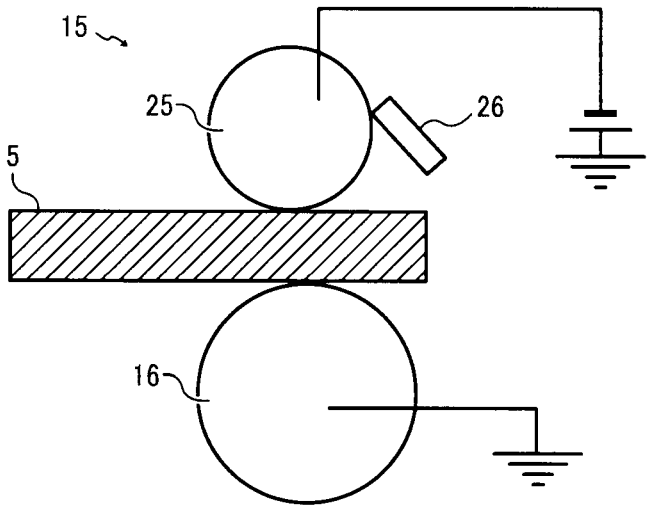
FIG. 14 schematically illustrates another embodiment of the surface potential equalizer including a roller-shaped surface potential equalizing member that also serves as a cleaning member.

FIG. 14 schematically illustrates another embodiment of the surface potential equalizer 15 including a roller-shaped surface potential equalizing member 25 that also serves as a cleaning member. In this embodiment, the roller-shaped surface potential equalizing member 25 removes residual toner particles remaining on the intermediate transfer belt 5 upon application of a cleaning bias, while charging the surface of the intermediate transfer belt 5 to a predetermined positive or negative potential upon application of a surface potential equalizing bias. A cleaning blade 26 is further provided to remove residual toner particles remaining on the roller-shaped surface potential equalizing member 25.

Figure 15:
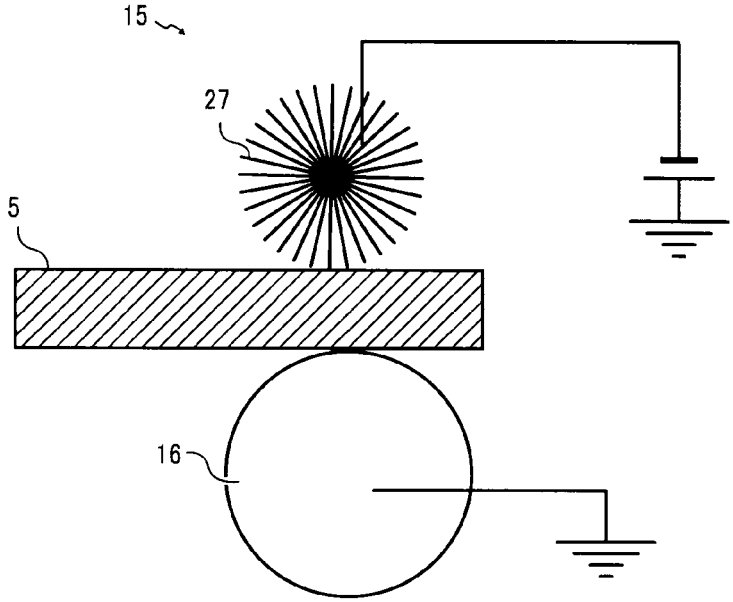
FIG. 15 schematically illustrates another embodiment of the surface potential equalizer including a brush-roller-shaped surface potential equalizing member that also serves as a cleaning member.

FIG. 15 schematically illustrates another embodiment of the surface potential equalizer 15 including a brush-roller-shaped surface potential equalizing member 27 that also serves as a cleaning member. In this embodiment, the brush-roller-shaped surface potential equalizing member 27 removes residual toner particles remaining on the intermediate transfer belt 5 upon application of a cleaning bias, while charging the surface of the intermediate transfer belt 5 to a predetermined positive or negative potential upon application of a surface potential equalizing bias.

In the embodiment illustrated in FIG. 13 employing the blade-shaped surface potential equalizing member 24, the cleaning bias and the surface potential equalizing bias may be applied simultaneously. In the embodiments illustrated in FIGS. 14 and 15 employing the roller-shaped surface potential equalizing member 25 and the brush-roller-shaped surface potential equalizing member 27, it is preferable that the surface potential equalizing bias is applied after the cleaning bias is applied.

Alternatively, residual toner particles remaining on the intermediate transfer belt 5 may be removed by the photoreceptors 2K, 2Y, 2M, and 2C. In this case, it is preferable that the surface potential equalizer 15 applies the cleaning bias to the residual toner particles before applying the surface potential equalizing bias to the intermediate transfer belt 5.

Figure 16:
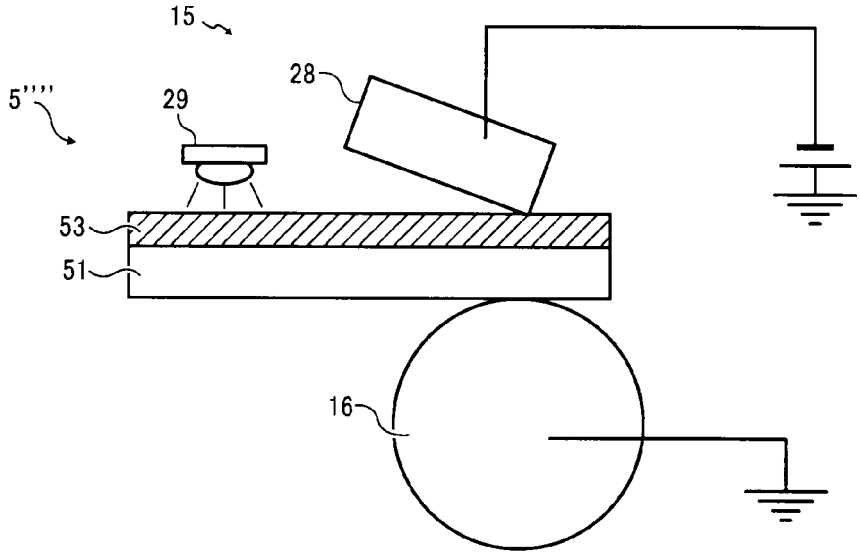
FIG. 16 schematically illustrates one embodiment of the surface potential equalizer including a blade-shaped surface potential equalizing member and a light emitting member.

In a case where an intermediate transfer belt 5"" comprising a high resistivity body 53 having photoconductivity is in use, the surface equalizer 15 preferably includes a light emitting member that emits light onto the intermediate transfer belt 5"" after the surface potential equalizing member equalizes the surface potential. FIG. 16 schematically illustrates one embodiment of the surface potential equalizer 15 including a blade-shaped surface potential equalizing member 28 and a light emitting member 29. After the secondary transfer process, the blade-shaped surface potential equalizing member 28 removes residual toner particles remaining on the intermediate transfer belt 5"", while charging the surface of the intermediate transfer belt 5"" to a predetermined positive or negative potential upon application of a surface potential equalizing bias. Thereafter, the light emitting member 29 further emits light onto the intermediate transfer belt 5"" so that the surface potential becomes zero. The light emitting member 29 may be a semiconductive laser, an LED, a halogen lamp, or a fluorescent lamp, for example.

Compared to a case where only the light emitting member 29 equalizes the surface potential of the intermediate transfer belt 5"", the intermediate transfer belt 5"" has more uniform surface potential of zero in a case where the light emitting member 29 emits light after the blade-shaped surface potential equalizing member 28 equalizes the surface potential of the intermediate transfer belt 5"". For example, when the intermediate transfer belt 5"" comprises a photoconductive material which easily transits from a negative potential to zero but is difficult to transit from a positive potential to zero, it is preferable that the blade-shaped surface potential equalizing member 28 equalizes the surface potential of the intermediate transfer belt 5"" to a negative potential before the light emitting member 29 emits light.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Experiment 1

In Examples 1-1 to 1-6, the intermediate transfer belt 5 illustrated in FIG. 3 is used. Specifically, the intermediate transfer belt 5 comprises a polyimide and is formed by centrifugal molding. The surface resistivity is varied and controlled by addition of a carbon black, as shown in Table 1. The thickness of the intermediate transfer belt 5 is 30 μm.

In Example 1-1, the surface potential equalizer illustrated in FIG. 8 is used. The brush-shaped surface potential equalizing member 17 applies a bias of from −300 to +300 V when equalizing the surface potential of the intermediate transfer belt 5. The brush-shaped surface potential equalizing member 17 is comprised of a 6-nylon having a fineness of 220T/96F, a density of 240 kf/inch$^2$, an original yarn resistance of 5 Log Ω, and a pile length of 5 mm.

In Examples 1-2 to 1-6, the surface potential equalizer illustrated in FIG. 9 is used. The roller-shaped surface potential equalizing member 18 applies a bias of 500 V when equalizing the surface potential of the intermediate transfer belt 5. The roller-shaped surface potential equalizing member 18 is formed by extrusion-molding an epichlorohydrin rubber layer dispersing a carbon black on an SUS cored bar having a diameter of 8 mm, accurately abrading the epichlorohydrin rubber layer to have a thickness of 3 mm, and spray-coating a silicone resin layer dispersing a carbon black having a thickness of 3 μm.

In Examples 1-1 to 1-6, the primary transfer bias is controlled to be a constant voltage of 500 V and the secondary transfer bias is controlled to be a constant current of 15 μA.

Under such conditions, color solid images and halftone images are continuously printed on both sides of each sheet of a normal paper TYPE T6200 (from Ricoh Co., Ltd.) and a dimply paper (from NBS Ricoh). Several sheets are subjected to evaluations of the resulting image quality, such as the degree of unevenness and residual image. The results are shown in Table 1.

TABLE 1

| Example No. | Surface Resistivity of Intermediate Transfer Belt (Ω/□) | Surface Potential Equalizing Member: Shape | Surface Potential Equalizing Member: Resistance (Ω) | Image Quality: Unevenness | Image Quality: Residual Image |
|---|---|---|---|---|---|
| 1-1 | $10^{13.5}$ | Brush | $10^5$ | Allowable | Allowable |
| 1-2 | $10^{15}$ | Roller | $10^6$ | Allowable | Allowable |
| 1-3 | $10^8$ | Roller | $10^6$ | Unallowable | Allowable |
| 1-4 | $10^{10}$ | Roller | $10^6$ | Unallowable | Allowable |
| 1-5 | $10^{12}$ | Roller | $10^6$ | Unallowable | Allowable |
| 1-6 | $10^{17.5}$ | Roller | $10^6$ | Allowable | Unallowable |

Table 1 shows that in Examples 1-1 and 1-2 using the intermediate transfer belt having a high surface resistivity of $10^{13}$Ω/□ or more, the resulting image quality is good.

In Examples 1-3 to 1-5 using the intermediate transfer belt having a surface resistivity of less than $10^{13}$Ω/□, the degree of residual image is allowable but unevenness is unallowable. This is because the transfer bias spreads along the surface of then intermediate transfer belt.

In Example 1-6 using the intermediate transfer belt having a surface resistivity of greater than $10^{17}$Ω/□, the degree of residual image is unallowable. This is because the surface potential history differs by location on the intermediate transfer belt 5, depending on whether or not the intermediate transfer belt 5 bears leading and trailing edges of a recording medium, a large amount of toner particles, or a small amount of toner particles. Additionally, variations in paper kind and environmental conditions cause electric discharge, resulting in abnormal images with white spots or black spots.

Experiment 2

In Examples 2-1 to 2-5, the intermediate transfer belt 5 used in Example 1-2, having a surface resistivity of $10^{15}$Ω/□, is used. The thickness of the intermediate transfer belt 5 is varied between 5 and 60 μm, as shown in Table 2. The thin intermediate belts are strengthened with a reinforcing tape having a width of 10 mm, the adhesive layer of the reinforcing tape adhering to the edges of the belts.

In Examples 2-1 to 2-5, the surface potential equalizer used in Example 1-2, including the roller-shaped surface potential equalizing member 18, is used. The roller-shaped surface potential equalizing member 18 applies a bias of 500 V when equalizing the surface potential of the intermediate transfer belt 5.

Under such conditions, images are produced in the same manner as Experiment 1, to evaluate voltage resistance and the resulting image quality, such as the degree of unevenness and transfer efficiency. The results are shown in Table 2.

TABLE 2

| Example No. | Thickness of Intermediate Transfer Belt (μm) | Voltage Resistance | Image Quality: Unevenness | Image Quality: Transfer Efficiency |
|---|---|---|---|---|
| 2-1 | 5 | Allowable | Allowable | Allowable |
| 2-2 | 20 | Allowable | Allowable | Allowable |
| 2-3 | 50 | Allowable | Allowable | Allowable |
| 2-4 | 3 | Unallowable | Unallowable | Allowable |
| 2-5 | 60 | Allowable | Allowable | Unallowable |

Table 2 shows that in Examples 2-1 to 2-3 using the intermediate transfer belt having a thickness of from 5 to 50 μm, both the voltage resistance and the resulting image quality are good.

In Example 2-4 using the intermediate transfer belt having a small thickness of 3 μm, the degree of unevenness is unallowable. This is because charges disadvantageously leak when a high transfer bias is applied at the primary and secondary transfer nips.

In Example 2-5 using the intermediate transfer belt having a large thickness of 60 μm, the transfer efficiency is unallowable. This is because a required amount of charges cannot exist on the surface due to the thickness.

Accordingly, Experiment 2 shows that the optimum thickness of the intermediate transfer belt 5 is from 5 to 50 μm.

Experiment 3

In Examples 3-1 to 3-5, the intermediate transfer belt 5 used in Example 1-1 and the surface potential equalizer used in Example 1-2, including the roller-shaped surface potential equalizing member 18, are used. The bias applied from the roller-shaped surface potential equalizing member 18 to the intermediate transfer belt 5 is varied, as shown in Table 3.

In Examples 3-1 to 3-5, the primary transfer bias is controlled to be a constant voltage of 500 V, and the secondary transfer bias is controlled to be a constant current of 15 μA when a normal paper is in use and a constant current of 10 μA when a thick paper is in use.

Under such conditions, color solid images and halftone images are continuously printed on both sides of each sheet of a normal paper TYPE T6200 (from Ricoh Co., Ltd.), a dimply paper (from NBS Ricoh), and a thick paper (having a basis weight of 180 g/m$^2$). Several sheets are subjected to evaluations the resulting image quality, specifically, the degree of residual image. The results are shown in Table 3.

TABLE 3

| Example No. | Applied Voltage (V) | Image Quality Residual Image |
|---|---|---|
| 3-1 | −100 | Allowable |
| 3-2 | −300 | Allowable |
| 3-3 | +300 | Allowable |
| 3-4 | none (floated) | Unallowable |
| 3-5 | none (grounded) | Slightly observable |

Table 3 shows that in Examples 3-1 to 3-3 in which a bias is applied to the roller-shaped surface potential equalizing member 18 to equalize the surface potential of the intermediate transfer belt 5, the resulting image quality is allowable.

In Example 3-4 in which the roller-shaped surface potential equalizing member 18 is floated, residual images are produced because the potential history remains in the intermediate transfer belt 5.

In Example 3-5 in which the roller-shaped surface potential equalizing member 18 is grounded, residual images are slightly observed. In this case, the grounded roller-shaped surface potential equalizing member 18 removes charges from the intermediate transfer belt 5 to some extent, but the potential variation cannot be completely removed.

Experiment 4

In Examples 4-1 and 4-2, the intermediate transfer belt 5 used in Example 1-1 and the surface potential equalizer illustrated in FIG. 12, including the sleeve electrode 22 and the carrier particles 22, are used. Each of the carrier particles 22 comprises a magnetite as the core material, a silicone resin as the coating material, and a titanium oxide as the resistivity controlling agent.

In Examples 4-3 and 4-4, the surface potential equalizer illustrated in FIG. 11, including the blade-shaped surface potential equalizing member 19 comprised of a conductive urethane rubber, and the water 20, is used. In Examples 4-3 and 4-4, the applied bias is positive, but is not limited thereto and is controllable.

In Example 4-5, the surface potential equalizer used in Example 3-1, including the roller-shaped surface potential equalizing member 18, is used.

In Examples 4-1 to 4-5, the bias applied from the surface potential equalizing members 21, 19, and 18 to the intermediate transfer belt 5 is varied, as shown in Table 4. The primary transfer bias is controlled to be a constant voltage of 500 V, and the secondary transfer bias is controlled to be a constant current of 15 μA when a normal paper is in use and a constant current of 10 μA when a thick paper is in use.

Under such conditions, color images are printed on several sheets of a dimply paper (from NBS Ricoh), a thick paper (having a basis weight of 216 g/m$^2$), and a postcard. Thereafter, halftone images are printed on a normal paper TYPE T6200 (from Ricoh Co., Ltd.), and are subjected to evaluations of the resulting image quality, such as the degree of unevenness and residual image. The results are shown in Table 4.

TABLE 4

| Example No. | DC Voltage (V) | Image Quality Unevenness | Image Quality Residual Image |
|---|---|---|---|
| 4-1 | −300 | Allowable | Unobservable |
| 4-2 | −100 | Allowable | Unobservable |
| 4-3 | 300 | Allowable | Unobservable |
| 4-4 | 100 | Allowable | Unobservable |
| 4-5 | −300 | Allowable | Slightly observable |

Table 4 shows that in Examples 4-1 to 4-4 in which the surface potential of the intermediate transfer belt 5 is equalized by charge injection, the resulting image quality is very good.

In Example 4-5 in which the surface potential of the intermediate transfer belt 5 is equalized by electric discharge, the resulting image quality is poorer than Examples 4-1 to 4-4.

The above results show that charge injection has an advantage over electric discharge in terms of equalization of the surface potential of the intermediate transfer belt 5.

Experiment 5

In Example 5-1, the surface potential equalizer used in Example 1-2, including the roller-shaped surface potential equalizing member 18, is used. The bias applied from the roller-shaped surface potential equalizing member 18 to the intermediate transfer belt 5 is a DC voltage of −300 V overlapped with an AC voltage having a peak-to-peak voltage ($V_{p-p}$) and a frequency of 700 V and 2 kHz, respectively, as shown in Table 5.

In Example 5-2, the surface potential equalizer used in Example 1-2, including the roller-shaped surface potential equalizing member 18, is used. The bias applied from the roller-shaped surface potential equalizing member 18 to the intermediate transfer belt 5 is a DC voltage of −300 V, as shown in Table 5.

In Examples 5-1 and 5-2, the primary transfer bias is controlled to be a constant voltage of 500 V, and the secondary transfer bias is controlled to be a constant current of 15 μA when a normal paper is in use and a constant current of 10 μA when a thick paper is in use.

Under such conditions, color images are printed on several sheets of a dimply paper (from NBS Ricoh), a thick paper (having a basis weight of 216 g/m$^2$), and a postcard. Thereafter, halftone images are printed on a normal paper TYPE T6200 (from Ricoh Co., Ltd.), and are subjected to evaluations the resulting image quality, such as the degree of unevenness and residual image. The results are shown in Table 5.

TABLE 5

| Example No. | DC voltage (V) | $V_{p-p}$ of AC voltage (V) | Image Quality | |
|---|---|---|---|---|
| | | | Unevenness | Residual Image |
| 5-1 | −300 | 700 | Allowable | Allowable |
| 5-2 | −300 | — | Allowable | Slightly observable |

Table 5 shows that in Example 5-1 in which the surface potential of the intermediate transfer belt 5 is equalized by the bias being a DC voltage overlapped with an AC voltage, the resulting image quality is good.

In Example 5-2 in which the surface potential of the intermediate transfer belt 5 is equalized by the bias being a DC voltage, residual images are slightly observed.

The above results show that the bias being a DC voltage overlapped with an AC voltage has an advantage over the bias being a DC voltage in terms of equalization of the surface potential of the intermediate transfer belt 5.

Experiment 6

In Example 6-1, the surface potential equalizer illustrated in FIG. 13, including the blade-shaped surface potential equalizing member 24 that also serves as a cleaning member, is used. The blade-shaped surface potential equalizing member 24 comprises a urethane material, and has a free length of 8 mm, a thickness of 2 mm. The surface resistivity thereof is $10^6\Omega/\square$, which is achieved by addition of a conductive resistivity controlling agent treated with an ion.

In Example 6-2, the surface potential equalizer illustrated in FIG. 14, including the roller-shaped surface potential equalizing member 25 that also serves as a cleaning member, equipped with the cleaning blade 26, is used. The roller-shaped surface potential equalizing member 25 is formed by extrusion-molding an epichlorohydrin rubber layer dispersing a carbon black on an SUS cored bar having a diameter of 8 mm, accurately abrading the epichlorohydrin rubber layer to have a thickness of 3 mm, and spray-coating a silicone resin layer dispersing a carbon black having a thickness of 3 μm. The roller-shaped surface potential equalizing member 25 has a surface resistivity of $10^6\Omega/\square$. The cleaning blade 26 comprises a urethane material, and has a free length of 8 mm, a thickness of 2 mm.

In Example 6-3, the surface potential equalizer illustrated in FIG. 15, including the brush-roller-shaped surface potential equalizing member 27 that also serves as a cleaning member, is used. The brush-roller-shaped surface potential equalizing member 27 is comprised of a 6-nylon having a fineness of 220T/96F, a density of 240 kf/inch$^2$, an original yarn resistance of 5 Log Ω, and a pile length of 5 mm.

In Examples 6-1 to 6-3, the intermediate transfer belt used in Example 1-1 is used. Each of the surface potential equalizing members 24, 25, and 27 applies a cleaning bias to the intermediate transfer belt 5, and subsequently applies the surface equalizing bias being a DC voltage of −300 V.

The primary transfer bias is controlled to be a constant voltage of 500 V, and the secondary transfer bias is controlled to be a constant current of 15 μA.

Under such conditions, color solid images and halftone images are continuously printed on both sides of each sheet of a normal paper TYPE T6200 (from Ricoh Co., Ltd.) and a dimply paper (from NBS Ricoh). Several sheets are subjected to evaluations of the resulting image quality, such as the degree of unevenness and residual image. The results are shown in Table 6.

TABLE 6

| Example No. | DC Voltage (V) | Image Quality | |
|---|---|---|---|
| | | Unevenness | Residual Image |
| 6-1 | −300 | Allowable | Allowable |
| 6-2 | −300 | Allowable | Allowable |
| 6-3 | −300 | Allowable | Allowable |

Table 6 shows that in Examples 6-1 to 6-3 in which the surface potential equalizing member is capable of removing residual particles remaining on the intermediate transfer belt 5, the resulting image quality is good. These results show that such a surface potential equalizing member is advantageous in terms of size and cost.

Experiment 7

In Example 7-1, an embodiment of the intermediate transfer belt 5" illustrated in FIG. 5, comprising the high-resistivity body 50 and the conductive layer 51, each having a thickness of 30 μm, is used. The high-sensitivity body 50 comprises a polycarbonate resin, and has a surface resistivity of $10^{14}\Omega/\square$. The conductive layer 51 comprises a polyimide material dispersing a carbon black, and has a surface resistivity of $10^6\Omega/\square$.

In Example 7-2, an embodiment of the intermediate transfer belt 5'" illustrated in FIG. 6, comprising the high-resistivity body 50, the conductive layer 51, and the support 52, each having a thickness of 20 μm, 500 Å, and 100 μm, respectively, is used. The high-sensitivity body 50 comprises a polycarbonate resin, and has a surface resistivity of $10^{14}\Omega/\square$. The conductive layer 51 is an aluminum-deposited layer, and has a surface resistivity of $10^2\Omega/\square$. The support 52 comprises a polyethylene terephthalate (PET).

In Example 7-3, another embodiment of the intermediate transfer belt 5" illustrated in FIG. 5, comprising the high-resistivity body 50 and the conductive layer 51, each having a thickness of 30 μm, is used. The high-sensitivity body 50 comprises a polycarbonate resin, and has a surface resistivity of $10^{14}\Omega/\square$. The conductive layer 51 comprises a polyimide material dispersing a carbon black, and has a surface resistivity of $10^{7.5}\Omega/\square$. (The amount of the carbon black in the conductive layer 51 is different from that in Example 7-1.)

In Examples 7-1 to 7-3, the primary transfer bias is controlled to be a constant voltage of 500 V, and the secondary transfer bias is controlled to be a constant current of 15 μA when a normal paper is in use and a constant current of 10 μA when a thick paper is in use. The bias being a DC voltage of −300 V is applied from the roller-shaped surface potential equalizing member 18 used in Example 3-2 to the intermediate transfer belt 5.

Under such conditions, color solid images and halftone images are continuously printed on both sides of each sheet of a normal paper TYPE T6200 (from Ricoh Co., Ltd.), a dimply paper (from NBS Ricoh), and a thick paper (having a basis weight of 180 g/m$^2$). Several sheets are subjected to evaluations of the resulting image quality, such as the degree of unevenness and residual image. The results are shown in Table 7.

TABLE 7

| Example No. | Surface Resistivity of Conductive Layer (Ω/□) | Image Quality: Unevenness | Image Quality: Residual Image |
|---|---|---|---|
| 7-1 | $10^6$ | Allowable | Allowable |
| 7-2 | $10^2$ | Allowable | Allowable |
| 7-3 | $10^{7.5}$ | Unallowable | Allowable |

Table 7 shows that in Examples 7-1 and 7-2 in which the conductive layer 51 has a surface resistivity of $10^6$Ω/□ or less, the resulting image quality is good. This is because the toner particles T can be normally transferred from the high-resistivity body 50 onto the recording medium P, as illustrated in FIG. 7B.

In Example 7-3 in which the conductive layer 51 has a surface resistivity of $10^{7.5}$Ω/□, the degree of unevenness is unallowable. This is because the layer 51 serves as a semi-conductive layer, and the toner particles T cannot be normally transferred from the high-resistivity body 50 onto the recording medium P where a gap is existing therebetween, as illustrated in FIG. 7A.

Experiment 8

In Example 8-1, an embodiment of the intermediate transfer belt 5"" illustrated in FIG. 16, prepared as follows, is used. First, 5 parts of a disazo pigment having the following formula (1) and 5 parts of a τ-type metal-free phthalocyanine pigment (from Toyo Ink Mfg. Co., Ltd.), both serving as a charge generation material, and 35 parts of tetrahydrofuran are subjected to a dispersion treatment for 5 days using a bead mill. The resulting mixture is further mixed with 100 parts of a Z-type polycarbonate resin having a molecular weight of 60,000, 300 parts of tetrahydrofuran, 80 parts of 4-diethylaminobenzaldehyde-1-benzyl-1-phenylhydrazone having the following formula (2), serving as a charge transport material, and 0.1 parts of a silicone oil (KF-50 from Shin-Etsu Chemical Co., Ltd.). Thus, a high-resistivity body liquid is prepared. The high-resistivity body liquid is spray-coated on a metallic belt comprising an SUS material having a thickness of 50 μm, followed by drying for 20 minutes at 130° C. Thus, an embodiment of the intermediate transfer belt 5"" comprising the high-resistivity body 53 having a thickness of 20 μm is prepared.

In Example 8-2, another embodiment of the intermediate transfer belt 5"" illustrated in FIG. 16, prepared as follows, is used. A charge generation layer liquid is prepared by mixing 12 parts of a disazo pigment having the above formula (1), serving as a charge generation material, 5 parts of a polyvinyl butyral, 200 parts of 2-butane, and 400 parts of cyclohexanone. A charge transport layer liquid is prepared by mixing 10 parts of a charge transport material having the following formula (3), 10 parts of a Z-type polycarbonate resin having a molecular weight of 60,000, and 100 parts of tetrahydrofuran. The charge transport layer liquid is spray-coated on a metallic belt comprising an SUS material having a thickness of 50 μm, and subsequently the charge generation layer liquid is spray-coated thereon, followed by drying for 20 minutes at 130° C. Thus, an embodiment of the intermediate transfer belt 5"" comprising the high-resistivity body 53 having a thickness of 20 μm is prepared.

(3)

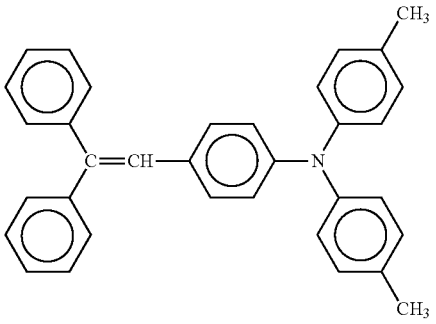

In Example 8-3, an embodiment of the intermediate transfer belt 5' illustrated in FIG. 4, prepared as follows, is used. A liquid including no charge generation material, no charge transport material, 10 parts of a polycarbonate, and 100 parts of tetrahydrofuran, is spray-coated on a metallic belt comprising an SUS material having a thickness of 50 μm, followed by drying for 20 minutes at 130° C. Thus, an embodiment of the intermediate transfer belt 5' comprising the high-resistivity body 50 having a thickness of 20 μm is prepared.

In Examples 8-1 to 8-3, the surface potential equalizer illustrated in FIG. 16, including the blade-shaped surface potential equalizing member 28 and the light emitting mem- (1)

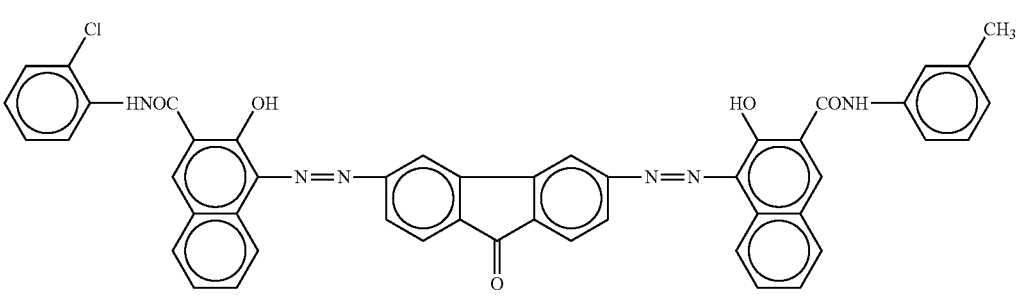

(2)

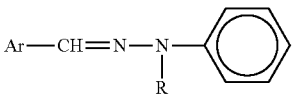

ber 29, is used. After the secondary transfer process, the blade-shaped surface potential equalizing member 28 equalizes the surface potential of the intermediate transfer belt, as well as removing residual toner particles remaining on the intermediate transfer belt. Thereafter, the light emitting member 29, specifically a semiconductive laser, emits light onto the intermediate transfer belt.

In Examples 8-1 to 8-3, the primary transfer bias is controlled to be a constant voltage of 500 V, and the secondary transfer bias is controlled to be a constant current of 15 μA. The surface potential equalizing bias applied to the intermediate transfer belt 5 is a DC voltage of −300 V.

Under such conditions, color images are printed on several sheets of a dimply paper (from NBS Ricoh), a thick paper (having a basis weight of 216 g/m$^2$), and a postcard. Thereafter, halftone images are printed on a normal paper TYPE T6200 (from Ricoh Co., Ltd.), and are subjected to evaluations of the resulting image quality, such as the degree of unevenness and residual image. The results are shown in Table 8.

TABLE 8

| | | Image Quality | |
|---|---|---|---|
| Example No. | Light Emission | Granularity | Residual Image |
| 8-1 | Yes | Allowable | Unobservable |
| 8-2 | Yes | Allowable | Unobservable |
| 8-3 | Yes | Allowable | Slightly observable |

In Examples 8-1 and 8-2 in which the intermediate transfer belt 5'''' comprises a charge generation material or layer and a charge transport material or layer, the resulting image quality is very good. This is because the light emitting member equalizes the surface potential of the intermediate transfer belt 5'''' at approximately 0 V by light emission, after the surface potential equalizing member equalizes the surface potential of the intermediate transfer belt 5'''' at a predetermined positive or negative potential by application of a bias.

In Example 8-3 in which the intermediate transfer belt 5' comprises no charge generation material or layer and no charge transport material or layer, the resulting image quality is poor. This is because the surface potential of the intermediate transfer belt 5' is not even.

Additional modifications and variations of the present invention are possible in light of the above teachings. It is therefore to be understood that within the scope of the appended claims the invention may be practiced other than as specifically described herein.

What is claimed is:

1. An image forming apparatus, comprising:

a latent image bearing member;

a charger that uniformly charges a surface of the latent image bearing member;

an irradiator that writes an electrostatic latent image on the charged surface of the latent image bearing member;

a developing member that supplies toner particles to the electrostatic latent image to form a toner image;

a transfer device comprising:

an intermediate transfer member comprising a high-resistivity body having a surface resistivity of $10^{13}\Omega/\square$ or more under dark conditions;

a primary transfer member that transfers the toner image from the latent image bearing member onto the intermediate transfer member at a primary transfer nip; and a secondary transfer member that transfers the toner image from the intermediate transfer member onto a recording medium at a secondary transfer nip; and a surface potential equalizer comprising a surface potential equalizing member that equalizes a surface potential of the intermediate transfer member at a predetermined positive or negative potential, the surface potential equalizer provided on a migration path of the intermediate transfer member from the secondary transfer nip to the primary transfer nip and between the secondary transfer nip and the primary transfer nip.

2. The image forming apparatus according to claim 1, wherein the high-resistivity body constitutes an outermost surface of the intermediate transfer member which bears the toner image, and the high-resistivity body has a thickness of from 5 to 50 μm.

3. The image forming apparatus according, to claim 2, wherein the intermediate transfer member further comprises a base layer comprising a conductive body and having a surface resistivity of $10^{13}\Omega/\square$ or less.

4. The image forming apparatus according to claim 1, wherein the surface potential equalizing member applies a bias to the intermediate transfer member by charge injection.

5. The image forming apparatus according to claim 1, wherein the surface potential equalizing member applies a bias to the intermediate transfer member, the bias being a direct current overlapped with an alternating current.

6. The image forming apparatus according to claim 1, wherein the high-resistivity body comprises a photoconductive material dispersing a charge generation material and a charge transport material in a binder agent, and wherein the surface potential equalizer further comprises a light emitting member that emits light onto the intermediate transfer member after the surface potential equalizing member equalizes the surface potential of the intermediate transfer member at a predetermined positive or negative potential.

7. The image forming apparatus according to claim 1, wherein the high-resistivity body comprises a multi layer photoconductive material comprising:

a charge generation layer dispersing a charge generation material in a binder agent; and a charge transport layer dispersing a charge transport material in a binder agent, wherein the surface potential equalizer further comprises a light emitting member that emits light onto the intermediate transfer member after the surface potential equalizing member equalizes the surface potential of the intermediate transfer member at a predetermined positive or negative potential.

8. The image forming apparatus according to claim 1, wherein the surface potential equalizing member further removes residual toner particles remaining on the intermediate transfer member after secondary transfer without being transferred onto the recording medium.

9. The image forming apparatus according to claim 1, wherein the high-resistivity body has a surface resistivity of $10^{13}\Omega/\square$ or more and less than $10^{17.5}\Omega/\square$ under dark conditions.

10. The image forming apparatus according to claim 1, wherein the surface potential equalizer further comprises a metallic roller.

11. The image forming apparatus according to claim 1, wherein the surface potential equalizer applies a bias to the intermediate transfer member using at least one of a DC voltage, a charge injection, and a superposition of DC and AC voltage.

12. The image forming apparatus according to claim 1, wherein:

the surface potential equalizer includes a blade-shaped surface potential equalizing member, and the surface potential equalizer applies a bias to the intermediate transfer member by charge injection through water between the blade-shaped surface potential equalizing member and the intermediate transfer member.

13. The image forming apparatus according to claim 1, wherein:

the surface potential equalizer includes a sleeve electrode as the surface potential equalizing member, and the surface potential equalizer applies a bias to the intermediate transfer member by charge injection through carrier particles between the sleeve electrode and the intermediate transfer member.

14. The image forming apparatus according to claim 13, wherein:

the sleeve electrode includes a magnet, and the magnet and the carrier particles form magnet brushes that inject charges into the intermediate transfer member.

15. The image forming apparatus according to claim 13, wherein:

the carrier particles comprise a core material, a coating material, and a resistivity controlling agent, the core material including at least one member selected from the group consisting of iron, ferrite, and magnetite, the coating material including a material selected from the group consisting of silicone resin, an acrylic resin, a polyester resin, a polyethylene resin, a fluorine-containing resin, and a nitrogen-containing resin, and the resistivity controlling agent including a material selected from the group consisting from a carbon black, an inorganic oxide, and a conductive fine particle.

* * * * *